United States Patent [19]

Kajikawa et al.

[11] 4,309,227

[45] Jan. 5, 1982

[54] ION-NITRIDING PROCESS

[75] Inventors: Takashi Kajikawa, Miki; Minoru Makimura; Satoru Kunise, both of Akashi; Satoshi Furuitsu, Kakogawa, all of Japan

[73] Assignee: Kawasaki Jukogyo Kabushiki Kaisha, Kobe, Japan

[21] Appl. No.: 57,008

[22] Filed: Jul. 12, 1979

[30] Foreign Application Priority Data

Jul. 14, 1978 [JP] Japan ..... 53-86560

[51] Int. Cl.[3] ..... C21D 1/48

[52] U.S. Cl. ..... 148/16.6; 148/20.3; 204/164

[58] Field of Search ..... 204/164; 148/13.1, 16, 148/16.6, 20.3

[56] References Cited

U.S. PATENT DOCUMENTS

| | | | |
|---|---|---|---|
| 3,190,772 | 6/1965 | Berghaus et al. | 148/16 |
| 3,228,809 | 1/1966 | Berghaus et al. | 148/16 |
| 3,616,383 | 10/1971 | Klaüesler | 148/16.6 |
| 3,730,863 | 5/1973 | Keller | 204/164 |

*Primary Examiner*—L. Dewayne Rutledge
*Assistant Examiner*—John P. Sheehan
*Attorney, Agent, or Firm*—Fleit & Jacobson

[57] ABSTRACT

Disclosed is an improved ion-nitriding process comprising ion-nitriding a workpiece at a high voltage level of glow discharge in a gas atmosphere resulting from the introduction of a gas mixture containing a specific amount of ammonia into a nitriding reactor, and then, further ion-nitriding the same workpiece at a lower voltage level of glow discharge in a gas atmosphere resulting from the introduction of a gas mixture not containing ammonia into the reactor.

2 Claims, 9 Drawing Figures

(A)

(B)

(A)

COMPOUND LAYER 8μ

(B)

NO COMPOUND LAYER (C)

NO COMPOUND LAYER (A)

COMPOUND LAYER 12μ

(B)

COMPOUND LAYER 10μ

(C)

COMPOUND LAYER 4μ

(A)

COMPOUND LAYER 18μ

(B)

COMPOUND LAYER 50 μ

(C)

COMPOUND LAYER 10 μ

(A)

COMPOUND LAYER 23 μ

(B)

COMPOUND LAYER 85 μ

(C)

COMPOUND LAYER 13 μ

ION-NITRIDING PROCESS

BACKGROUND OF THE INVENTION

The present invention relates to a process for ion-nitriding a metal workpiece by means of a glow discharge.

An ion-nitriding process is a process of hardening the surface of a metal workpiece in which the workpiece is subjected to a glow discharge in an atmosphere of a nitrogen-containing gas so that the nitrogen ions produced by the glow discharge are caused to bombard upon the workpiece to effect nitriding. As the nitriding medium, a gas mixture containing nitrogen and hydrogen has been generally employed. In such ion-nitriding process, a workpiece is bombarded by nitrogen ions and hydrogen ions to be heated and caused to release, from the surface thereof, Fe atoms which will react with atomic nitrogen to produce FeN. The FeN compound is deposited on the surface of the workpiece, which has been cleaned by the action of the bombardment of the ions, so as to increase the nitrogen potential. Through such mechanism, the ion-nitriding process is effective to provide a finely nitrided surface layer on a metal workpiece. The ion-nitriding process is also advantageous in that the process is carried out under a vacuum so as to minimize the consumption of the processing gas and further that there is no risk of air pollution.

However, the ion-nitriding process has been conventionally practised in such a manner that the composition of a nitriding gas medium, most generally a gas mixture of nitrogen and hydrogen, is constant throughout the ion-nitriding process, and is disadvantageous in that it takes a long period of time to obtain a desired product having a uniform and sufficiently thick nitrided surface layer. Thus, the conventional ion-nitriding process consumes much energy per cycle of the ion-nitriding treatment; in other words, it does not efficiently use the energy supplied by the glow discharge.

Accordingly, a principal object of the present invention is to overcome the above disadvantages and to provide an improved process for ion-nitriding a metal workpiece, by which the workpiece is ion-nitrided in a very short period of time to produce a product having a uniform and sufficiently thick nitrided surface layer.

SUMMARY OF THE INVENTION

According to the present invention, the above and other objects are accomplished by ion-nitriding a metal workpiece by means of glow discharge at a high voltage level in a gas atmosphere resulting from the introduction, into a vacuum nitriding reactor, of a gas mixture of nitrogen, hydrogen and ammonia in which the ammonia is present at least 20% by volume. The same workpiece is then further ion-nitrided at a lower voltage level of glow discharge in a gas atmosphere not containing ammonia.

DESCRIPTION OF THE PREFERRED EMBODIMENT

Figure 1:
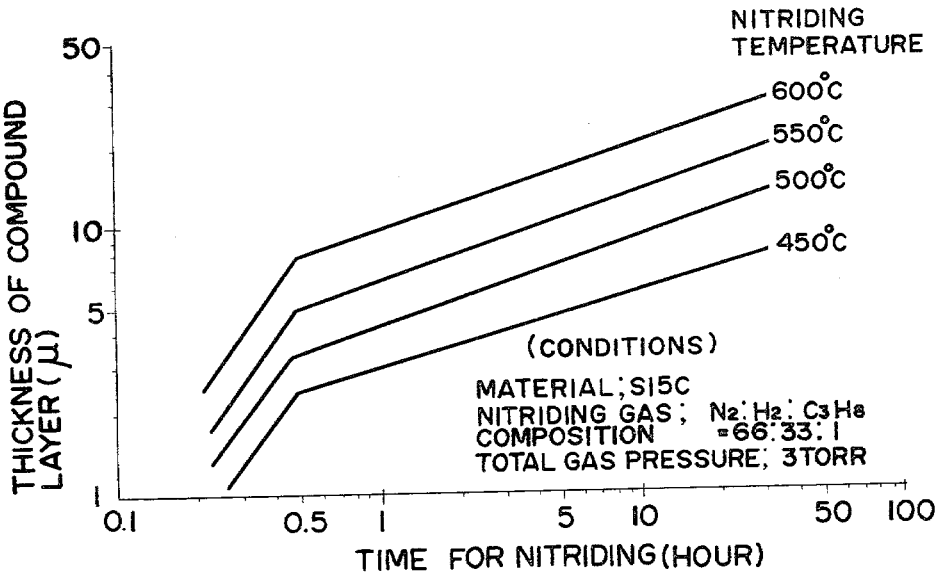
FIG. 1 is a graph showing the thickness of the compound layer of the products obtained from the conventional ion-nitriding process versus the time for ion-nitriding at various temperatures.

On extensively studying the thickness of the layer of compound (nitride) on the surface of a workpiece versus the time required for ion-nitriding at various temperatures, the present inventors have discovered the fact that the rate of forming such layer is distinctively different before and after a certain time from the beginning of the ion-nitriding. For example, as seen from FIG. 1 where the forming rates at various temperatures are recorded in terms of a log-log graph with compound layer thickness vertically and time for nitriding horizontally, the slope of each of the lines up to approximately 0.5 hour is 1 while that after 0.5 hour is ½. The inventors have analyzed this fact at follows: The rate of forming the layer on the surface of a workpiece may be determined, at the initial step of an ion-nitriding process (that is, up to 0.5 hour or so from the initiation of the ion-nitriding), by the rate of surface reaction, and then, in the subsequent stage, by the rate of diffusion.

Thus, the present invention has been accomplished by activating the uppermost surface of the workpiece, in the initial step of the ion-nitriding (in which the nitriding rate is determined by the surface reaction), so as to accelerate the rate of the surface reaction and thereby accelerate the nitriding of the workpiece. More specifically, according to the present invention, the period of time for ion-nitriding the workpiece so as to obtain a desired product having a surface layer of compound in a sufficient thickness can be greatly shortened by preliminarily ion-nitriding the workpiece by means of a glow discharge in an atmosphere of a nitriding gas mixture containing ammonia gas so that the glow discharge voltage is increased to a higher level to accelerate the ion-nitriding of the uppermost surface of the workpiece. Then, the same workpiece is subjected to a further ion-nitriding step in an atmosphere of a gas mixture of nitrogen and hydrogen, that is, a gas mixture not containing ammonia, at a lower level of glow discharge voltage. In such subsequent ion-nitriding step, where the rate of forming the compound layer will be determined by the diffusion rate, i.e. the rate of the diffusion of nitrogen through the surface of the workpiece into the body thereof, even the activation of the uppermost surface of the workpiece, by applying a higher voltage due to the presence of ammonia, will not serve to accelerate the rate of nitriding since such diffusion rate is determined by the material to be nitrided and the temperature at which the ion-nitriding is carried out.

Figure 2:
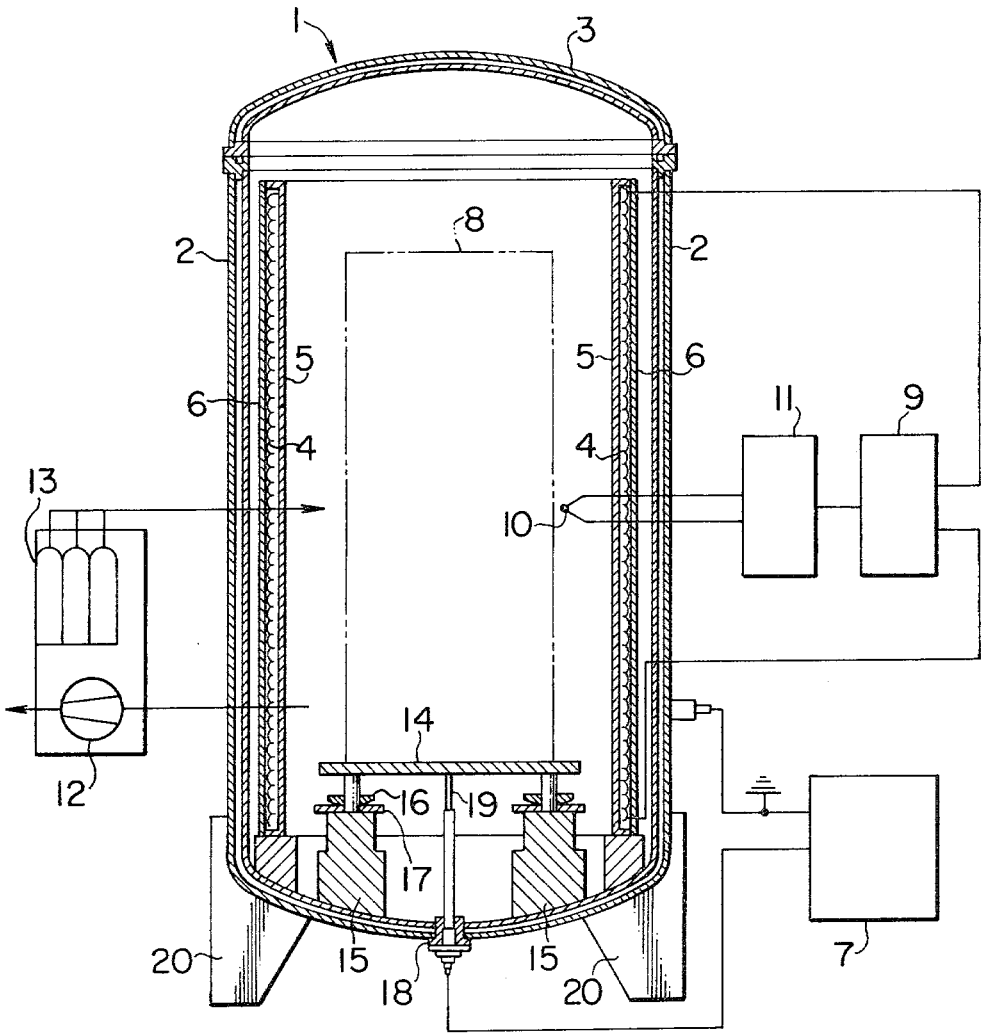
FIG. 2 is a schematic representation of an apparatus suitable for carrying out the present invention.

The present invention will now be described with reference to an apparatus, as shown in FIG. 2, for carrying out the process of the present invention. The apparatus includes a vacuum nitriding reactor 1 of a steel material, and the reactor is composed of a cylindrical casing 2 and an upper closure 3 for covering an upper entrance for putting in and taking out a workpiece. The casing 2 and the closure 3 are of double-walled construction to provide cooling water jackets therein. In the reactor 1, there is a cylindrical heat-radiating element 4 which is shielded from the workpiece 8 by an inner shielding plate 5 and an outer shielding plate 6 for reflecting the heat. The heat-radiating element 4 may be made of a graphite cloth heater, a sheath heater, a nichrome heater or the like.

A glow discharge power source 7 is connected so that the inner shielding place 5 serves as anode and the workpiece 8 in the vacuum reactor 1 as cathode. DC voltage is applied between the two electrodes and its level is controlled so as to produce a glow discharge for a controlled period of time. The heat-radiating element 4 is connected with an AC power source 9, whose power is controlled by a temperature controlling device 11 equipped with a temperature sensing thermocouple 10. The temperature in the vacuum reactor or the temperature of the workpiece 8 in the vacuum reactor 1 is thus sensed by the thermocouple 10 and the AC power source 9 is controlled by the temperature controlling device 11 in accordance with the temperature sensed by the thermocouple 10. The reactor 1 is connected with a vacuum pump 12 for evacuating the reactor 1. The vacuum reactor 1 is further connected with a gas supplying device 13 which supplies a gas or a gas mixture, including nitrogen, hydrogen or ammonia, into the reactor 1.

The workpiece 8 is placed on a table 14, serving as cathode, which is supported by an electrically insulative base members 15 at the bottom of the reactor 1 through discs 16 and plates 17. Each of the discs 16 is made of an electrically conductive material and has a convex lower surface, and each of the plates 17 is made of an insulative material and has a plane upper surface, and these members serve to prevent the concentration of a glow discharge. The table 14 is connected with a cathode terminal 19 through a fitting 18 which is electrically insulative and gas-tightly secured to the reactor. The reactor 1 is supplied on legs 20.

Figure 3:
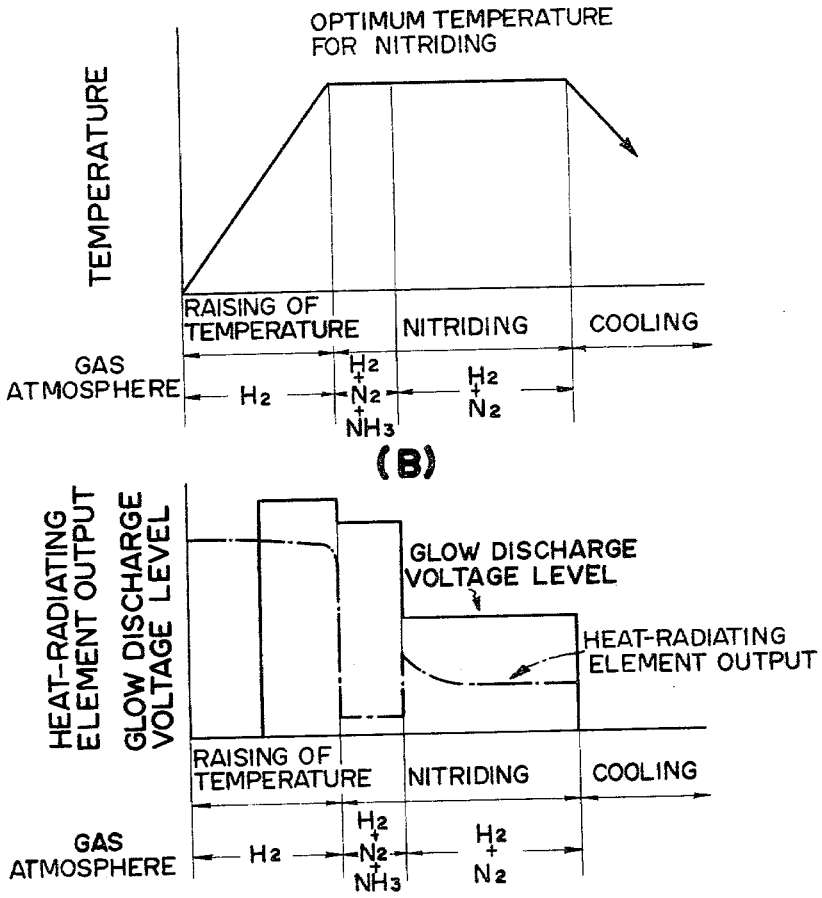
FIGS. 3(A), (B) and FIGS. 4(A), (B) diagrammatically show the modes of the practice of the steps of the process according to the present invention.

An example of the operation of the ion-nitriding of the present invention with such an apparatus is now described by reference to FIG. 3. The vacuum reactor 1 is evacuated by the vacuum pump 12, and then charged with hydrogen gas by the gas supplying device 13 to a pressure level of 1–10 Torr. Under such a reducing atmosphere in the reactor 1, the power source is energized to make the element 4 radiate heat, and the power source 7 is also energized so that a DC voltage is applied between the inner insulating plate 5 as anode and the table 14 (the workpiece 8) as cathode to produce a glow discharge. Thus, by the function of the glow discharge and heat radiated from the element 4, the workpiece is heated up to a temperature at which the workpiece can be ready to be nitrided, i.e., a temperature in the range of 300° to 570° C., preferably 550° to 560° C. Such a glow discharge in the hydrogen atmosphere, whose voltage level is as high as approx. 700 V, is effective in raising the temperature of the workpiece 8 and cleaning the surface of the workpiece through the reducing action, but, is not so effective in removing, by the sputtering action, the film of passive state substances from the surface of the workpiece 8 since the weight of hydrogen ion is light.

After the workpiece is heated up to the desired temperature as stated above, it is ion-nitrided by means of a glow discharge in the atmosphere of a nitriding gas mixture supplied from the gas supplying device 13. It is noted that the initial stage of the ion-nitriding should be carried out in an atmosphere of a gas mixture containing ammonia in addition to nitrogen and hydrogen, such mixture containing ammonia at least 20% by volume. Such preliminary ion-nitriding stage is carried out, at a voltage level of the glow discharge higher than that for normal ion-nitriding, for example, at the voltage as high as 560 V, and for a short period of time, preferably 15–60 minutes. The rise of the temperature, which would result from the high voltage glow discharge, can be prevented by the temperature controlling device 11 by which the power to be applied to the element 4 is reduced. Thus, the temperature at which the ion-nitriding is carried out can be maintained constant throughout the ion-nitriding stage.

Figure 4:
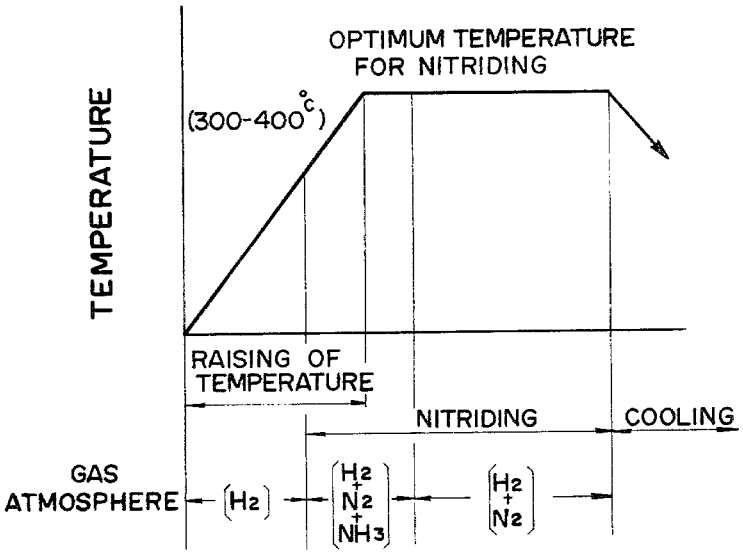
Figure 4:
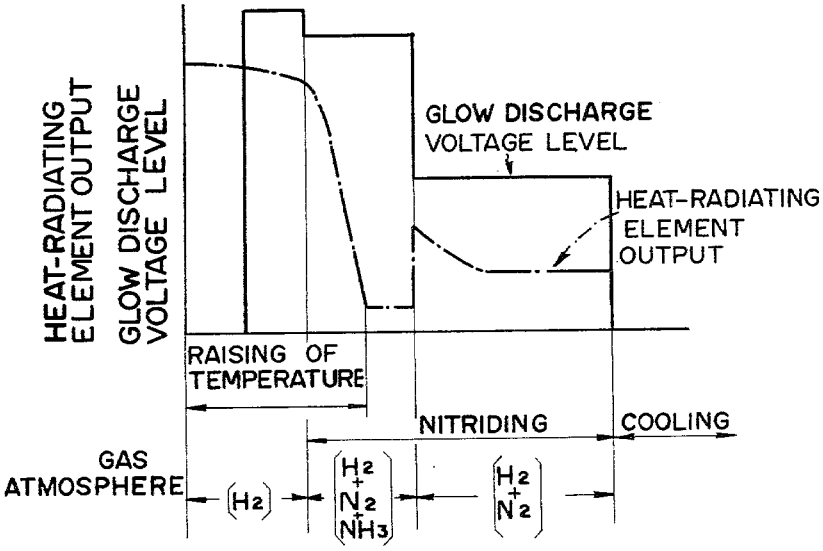

Another example of the practice of the present invention is described with reference to FIG. 4. As is in the case described with reference to FIG. 3, the reactor 1, evacuated by the pump 12, is charged with hydrogen gas to a pressure level of 1–10 Torr. AC voltage is applied to the element 4 to make it generate heat and further DC voltage is applied to the electrodes by means of the source 7 to produce a glow discharge. Through the glow discharge as well as the heat generated by the element 4, the workpiece is heated up to a minimum temperature at which the workpiece can be nitrided by means of a glow discharge, namely, to 300°–400° C. The voltage level of the glow discharge in the hydrogen gas atmosphere can be as high as 700 V, but, the efficiency of cleaning the surface of the workpiece 8 due to the sputtering in such hydrogen glow discharge is found to be relatively low because of the light weight of hydrogen ions.

When the workpiece is thus heated up to the above temperature, the hydrogen gas in the reactor 1 is replaced with a gas mixture of nitrogen, hydrogen and ammonia in which the ammonia is present at least 20% by volume in the gas mixture, and then, the workpiece is further heated up to an optimum temperature for ion-nitriding while the ion-nitriding of the workpiece is carried out at a higher voltage level of glow discharge, for example, on the order of 540 V. Even after the workpiece is heated up to the optimum temperature, the glow discharge at the high voltage level is continued at that temperature for a short period of time, preferably for 15 to 60 minutes, where temperature control is accomplished with the temperature controlling device 11 which functions to reduce the output power of the element 4 so that the temperature is kept constant without causing over-heating. Thus, at the initial stage of the ion-nitriding, by means of the glow discharge at the high voltage level due to the addition of ammonia in the nitriding gas, the uppermost surface of the workpiece 8 is activated, and further, the film of the passive state substances formed on the surface of the workpiece 8, particularly when the workpiece is of a stainless steel or the like, is removed by the sputtering function, so as to accelerate the nitriding of the workpiece. These effects can be construed that the surface of the metal workpiece is bombarded by ammonium ion $NH_4^+$, in addition to nitrogen atoms, which are heavier than hydrogen ions $H^+$, so that the sputtering action thereby efficiently proceeds.

When such preliminary ion-nitriding is completed, the gas mixture in the reactor 1 is replaced with a gas mixture containing nitrogen and hydrogen but not containing ammonia. Then, in such an atmosphere of a gas mixture where the ammonia is not positively added, the workpiece is further nitrided by means of glow discharge whose voltage level is lower, for example, 450 V, for a desired period of time, for example, 3–4 hours. The maintenance of the temperature for the nitriding of the workpiece is accomplished by increasing the output of the heat-radiating device 4. After such ion-nitriding for the desired period of time is completed, the glow discharge and the heating element 4 are shut down so as to allow the workpiece to be cooled. The workpiece is then taken out from the vacuum reactor 1.

As stated above, by the addition of ammonia into the nitriding gas medium according to the present invention, in an amount of at least 20% and even up to 100% by volume in the medium, a glow discharge can be effected in a stable manner without transferring to an arc discharge, at a higher voltage level than in the case where the ammonia is not added in the nitriding gas medium, so that a workpiece is ion-nitrided in a short period of time to a desired product having a surface layer of nitride of sufficient thickness. For example, under the glow current density (glow current divided by the area of the cathode) of approx. 11 $A/m^2$ and the total gas pressure in the glow discharge reactor of 3 Torr, the glow discharge voltage can be increased to such a high level as 560 V when the gas mixture introduced in the nitriding reactor contains 30% or more by volume of ammonia together with nitrogen and hydrogen in the ratio of $N_2/H_2=\frac{1}{3}$, while the glow discharge is only 450 V when the gas does not contain ammonia, that is, the gas consists of $N_2:H_2:NH_3=25:75:0$.

The present invention is most generally practised under the conditions where the ratio of nitrogen to hydrogen in the gas mixture introduced is 1:3. However, the present invention may be principally conducted with a higher ratio of nitrogen to hydrogen in the gas mixture introduced, for example, up to 2/1, particularly when it is desired to ion-nitride a workpiece even in the opening areas thereof. In a case where the ratio of nitrogen to hydrogen is relatively high, the voltage level of glow discharge will somewhat decrease, correspondingly. However, even in such a case, the addition of ammonia into the nitriding gas mixture at the initial stage of ion-nitriding process will shorten very much a period of time for producing a product having a thick nitride layer.

In the case where it is necessary to prevent a workpiece from overheating as a result of the increase of glow discharge voltage level, the glow discharge may be intermittently produced. In such a manner, the voltage level of the glow discharge can be intermittently as high as the maximum value, while the effective value of voltage level (which corresponds to the voltage level averaged over the entire time for processing and will determine the effect of heating the workpiece) can be kept low.

The invention can more readily be understood from the following example. The example, however, is not intended to illustrate the invention and is not to be so construed as to limit the scope of the invention.

EXAMPLE

Each of workpieces, made of S15C (an ordinary steel), SUS 304 (a stainless steel) or 21-4N (a valve steel), is subjected to ion-nitriding treatment by means of glow discharge with the nitriding gas medium containing or not containing ammonia, the conditions of which are listed below.

The ion-nitriding with the use of the nitriding gas not containing ammonia:

Composition of nitriding gas mixture; $N_2:H_2:NH_3=25:75:0$
Total gas pressure; 3 Torr
Nitriding temperature; 550° C.
Voltage level of glow discharge; 450 V
Time for nitriding; 4 hours The ion-nitriding with the use of the nitriding gas containing ammonia:

1. Preliminary ion-nitriding
Composition of nitriding gas mixture; a gas mixture of $N_2$, $H_2$ and $NH_3$ where the amount of $NH_3$ varies, from one case to another case, with the constant values of $N_2/H_2=\frac{1}{3}$ by volume.
Total gas pressure; 3 Torr
Nitriding temperature; 550° C.
Voltage level of glow discharge; 560 V
Time for nitriding; 0.5 hour
2. Finishing ion-nitriding
Composition of nitriding gas mixture:
$N_2:H_2:NH_3=25:75:0$
Total gas pressure; 3 Torr
Nitriding temperature; 550° C.
Voltage level of glow discharge; 450 V
Time for nitriding; 3.5 hours It is noted in every one of the cases the glow current density is 11.5 $A/m^2$.

Figure 5:
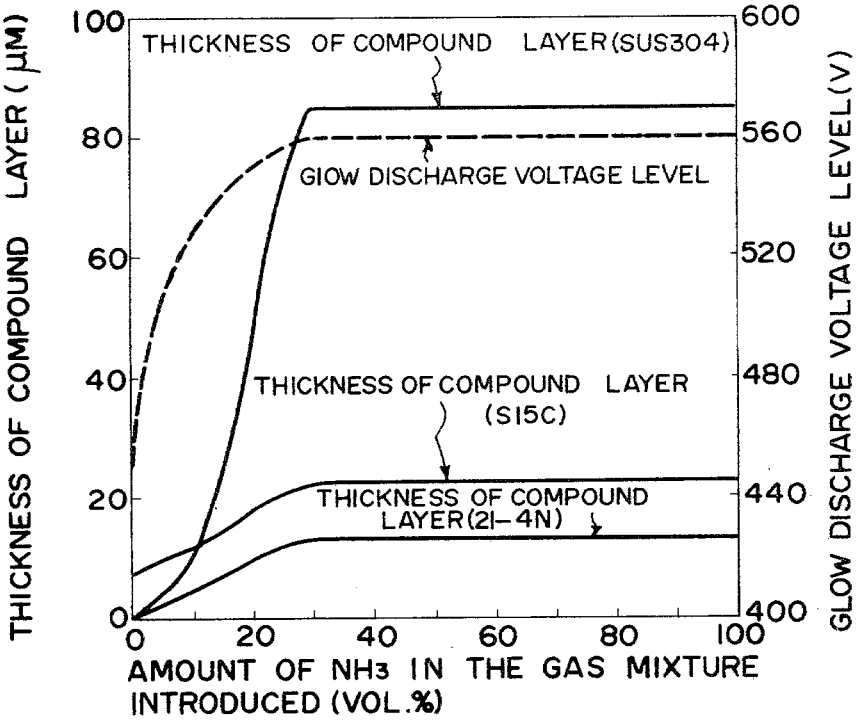
FIG. 5 is a graph showing the thickness of the compound layer of the products obtained from the ion-nitriding process in the gas atmosphere with varying the amount of ammonia, including the present invention.

The results are graphically shown in FIG. 5. As seen from that figure, under the conditions of the same glow current density, 11.5 $A/m^2$, and the same total gas pressure, 3 Torr, the voltage level of glow discharge increases along with corresponding increase of the amount of ammonia in the gas mixture introduced into the nitriding reactor until the ammonia is present in an amount of approx. 30% by volume in said gas mixture, and then, can be kept constant at the high level (560 V) when the ammonia is present in an amount of approx. 30% and even up to 100% by volume. Remarkably, also as seen from FIG. 5, the thickness of the compound layer formed on the workpiece is closely related to the glow discharge voltage level and, hence, the amount of the ammonia in the gas mixture introduced in the nitriding reactor. It was found that a product having the compound layer of an allowable thickness can be obtained when the gas mixture introduced contains at least 20% by volume of ammonia.

The optical microscopic photographs of some of the products obtained from the ion-nitriding treatments described above are shown in FIG. 6 through FIG. 9, the references of which are listed in the following table with the values of the thickness of the compound layer.

Figure 6:
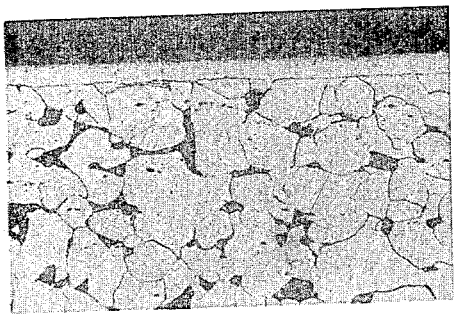
FIG. 6, FIG. 7, FIG. 8 and FIG. 9 show optical microscopic photographs of the products obtained from the ion-nitriding process including the present invention.
Figure 6:
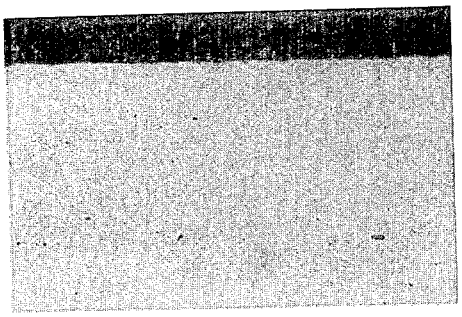
Figure 6:
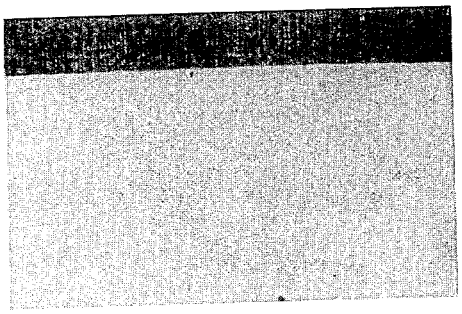
Figure 7:
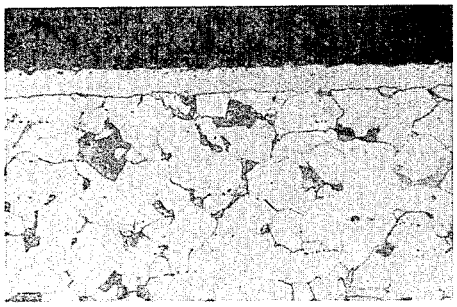
Figure 7:
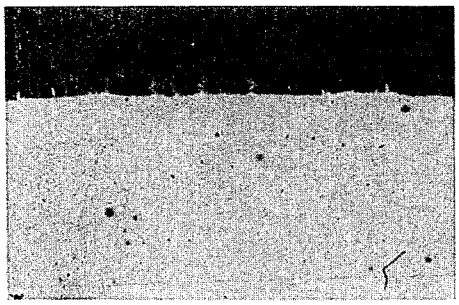
Figure 7:
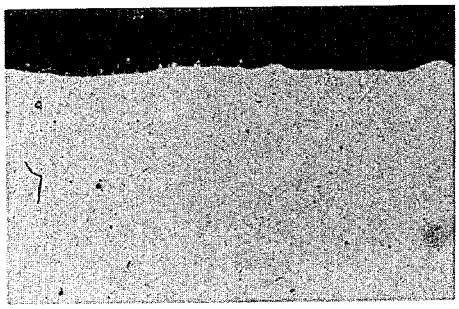
Figure 8:
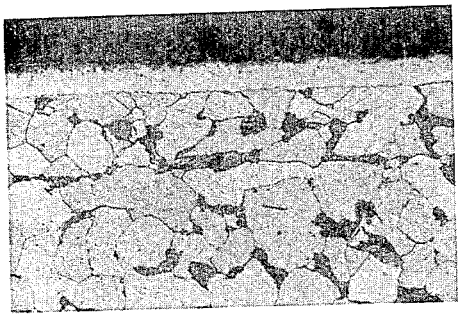
Figure 8:
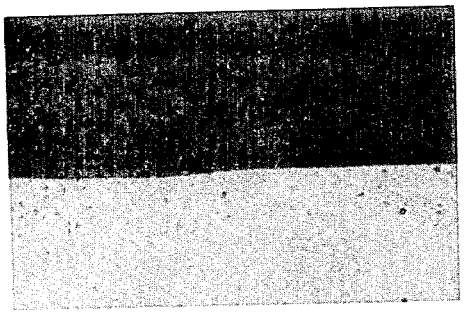
Figure 8:
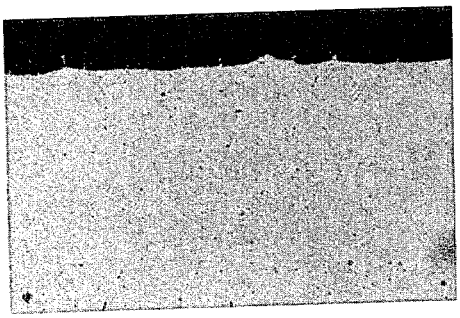
Figure 9:
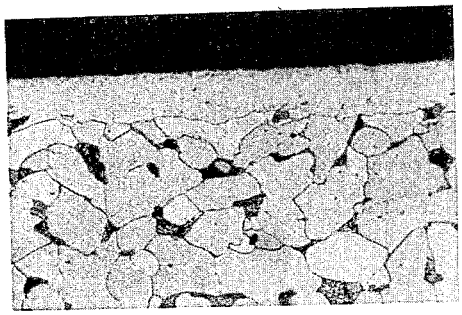
Figure 9:
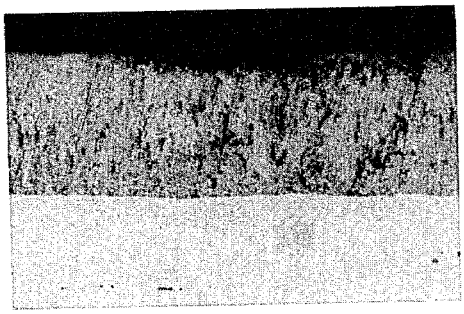
Figure 9:
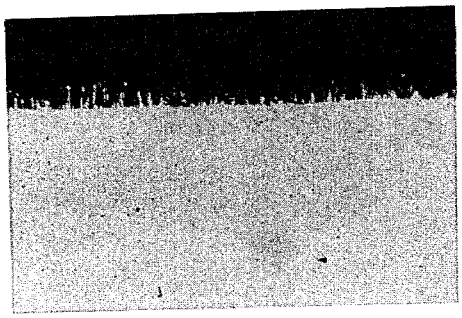

| | Composition of gas mixture introduced. | | | |
|---|---|---|---|---|
| Workpiece | $N_2:H_2:NH_3$ =25:75:0 | $N_2:H_2:NH_3$ =22.5:67.5:10 | $N_2:H_2:NH_3$ =20:60:20 | $N_2:H_2:NH_3$ =15:45:40 |
| S15C | FIG. 6 (A) (8μ) | FIG. 7 (A) (12μ) | FIG. 8 (A) (18μ) | FIG. 9 (A) (23μ) |
| SUS 304 | FIG. 6 (B) (No compound layer) | FIG. 7 (B) (10μ) | FIG. 8 (B) (50μ) | FIG. 9 (B) (85μ) |
| 21-4N | FIG. 6 (C) (No compound layer) | FIG. 7 (C) (4μ) | FIG. 8 (C) (10μ) | FIG. 9 (C) (13μ) |

The workpieces of S15C are nitrided to a product having the compound layer of thickness 18μ when the gas mixture introduced contains 20% by volume of ammonia, and further, even to a product having the compound layer as high as 23μ when the gas mixture contains 40% by volume of ammonia, while the thickness of the compound layer of the product is only 8μ in the case where ammonia is not added in the nitriding gas mixture. In addition, when a workpiece of S15C is subjected to another ion-nitriding treatment according to the present invention, where preliminary ion-nitriding is practised for 0.5 hour with the nitriding gas mixture of $N_2$:$H_2$:$NH_3$=15:45:40 and then, finishing ion-nitriding is practised for 0.5 hour with the nitriding gas mixture of $N_2$:$H_2$:$NH_3$=25:75:0 (thus, the entire period for ion-nitriding is only 1 hour) with the other operational conditions being the same as those as stated above, it is found that the workpiece is ion-nitrided to a product having the compound layer of 8μ. Thus, it is noted that the period of time for ion-nitriding a workpiece to a product having a desired thickness of compound layer can be extremely shortened according to the present invention. Such effects result from the fact that, as the initial stage of the ion-nitriding in which the nitriding rate is determined by the surface reaction, the high voltage level of the glow discharge due to the addition of ammonia will accelerate the surface reaction on the workpiece and thereby accelerate the nitriding of the workpiece to thicken the compound layer of the product.

Furthermore, the workpiece of the stainless steel, SUS 304, is effectively ion-nitrided to a product with the compound layer (the nitride layer) of thickness, 50μ, when the glow discharge is effected by the introduction of the gas mixture containing 20% by volume of ammonia in the preliminary ion-nitriding. The workpiece of SUS 304 can be nitrided so that the product has the compound layer as high as 85μ, in such a short period of time as 4 hours, in the case where the gas mixture introduced in the initial stage of the ion-nitriding contains 40% by volume of ammonia. These are in sharp contrast to the fact that there are observed no nitride layer in the product, in the same period of time, when ammonia is not added to the nitriding gas mixture. It is also noted that, in the same period of time, the workpiece of 21-4N is ion-nitrided to a product having the nitride layer of 13μ with the use of the gas mixture containing 40% by volume of ammonia, while the workpiece of 21-4N cannot be nitrided with the use of the nitriding gas mixture not containing ammonia. A product of 21-4N having the nitride of a desired thickness, say, in the order of 10μ, can be obtained, in only 4 hours, when the workpiece is subjected to the preliminary ion-nitriding with the use of the gas mixture containing 20% by volume of ammonia, and then, to the post (finishing) ion-nitriding with the nitriding gas mixture not containing ammonia. The fact that the workpiece, such as that of SUS 304 or 21-4N, is highly nitrided according to the present invention can be construed: The glow discharge at the high voltage level due to the addition of ammonia to the nitriding gas will accelerate the movement of the ions to be bombarded with the surface of the workpiece so as to remove the film of the passive state substances formed on the workpiece.

As described in the above, in the practice of the present invention, a workpiece is heated up, by the cooperative functions of the glow discharge and the heating element 4, to a temperature at which the workpiece is ion-nitrided, and is maintained at that temperature by controlling the output of the element. Such a method is advantageous in that the heating and the nitriding of the workpiece can be conducted with the efficient use of supplied energy, and further that the local overheating of the workpiece or the temperature distribution in the nitriding reactor can be prevented, thereby uniformly nitriding the workpiece. However, it should be noted that the present invention can also be principally practiced in such a manner that the heat supply for the ion-nitriding is accomplished only through the function of a glow discharge, without the use of a heating device.

What is claimed is:

1. A process for ion-nitriding a metal workpiece by means of a glow discharge in a gas atmosphere containing nitrogen in a vacuum reactor, comprising the steps of ion-nitriding the workpiece at a high voltage level of glow discharge in a gas resulting from the introduction, into the reactor, of a gas mixture of nitrogen, hydrogen and ammonia in which the amount of the ammonia is at least 20% by volume, replacing the gas atmosphere with a gas mixture containing nitrogen and hydrogen but not containing ammonia and then further ion-nitriding the same workpiece at a lower voltage level of glow discharge in the gas atmosphere resulting from the introduction, into the reactor, of the gas mixture of nitrogen and hydrogen not containing ammonia.

2. A process as claimed in claim 3 in which the voltage level of glow discharge in the first ion-nitriding step is 560 V and that in the second ion-nitriding step is 450 V, and in which the ratio of nitrogen to hydrogen in the gas mixture introduced in both of the steps is 1:3.

* * * * *